US006830360B1

(12) United States Patent
Galvez

(10) Patent No.: US 6,830,360 B1
(45) Date of Patent: Dec. 14, 2004

(54) PORTABLE, LED ILLUMINATOR

(75) Inventor: James M. Galvez, San Dimas, CA (US)

(73) Assignee: National Electric Manufacturing Corporation, Commerce, CA (US)

( * ) Notice: Subject to any disclaimer, the term of this patent is extended or adjusted under 35 U.S.C. 154(b) by 0 days.

(21) Appl. No.: 10/619,119

(22) Filed: Jul. 15, 2003

(51) Int. Cl.[7] ..... F21V 33/00
(52) U.S. Cl. ..... 362/249; 362/396; 362/800
(58) Field of Search ..... 362/184, 185, 362/191, 240, 249, 252, 396, 800; 315/185 R, 185 S, 192

(56) References Cited

U.S. PATENT DOCUMENTS 4,939,426 A * 7/1990 Menard et al. ..... 315/185 R
5,653,529 A * 8/1997 Spocharski ..... 362/396
5,688,042 A * 11/1997 Madadi et al. ..... 362/240
6,736,525 B2 * 5/2004 Chin ..... 362/249
2003/0095404 A1 * 5/2003 Becks et al. ..... 362/184

* cited by examiner

*Primary Examiner*—Y My Quach Lee
(74) *Attorney, Agent, or Firm*—William W. Haefliger

(57) ABSTRACT

An illumination device, comprising in combination an elongated portable carrier including a housing and a longitudinal elongated window; multiple LEDs carried to emit light toward and through the window; and circuitry associated with the housing to supply electrical power to the LEDs, the circuitry incorporating resistor, capacitor and diode elements to reduce AC input voltage to a level for supply to the LEDs.

11 Claims, 3 Drawing Sheets

PORTABLE, LED ILLUMINATOR

BACKGROUND OF THE INVENTION

This invention relates generally to portable illumination devices and more particularly to an improved device wherein LEDs are provided within an elongated, hand-held portable carrier.

There is need for improvements in portable illumination devices wherein complexity of electrical circuitry required for power supply to LEDs is reduced, and wherein there is no need for a transformer to reduce supply voltage. There is also need for an improved simple, lightweight, rugged device employing an elongated tubular carrier in which a row or rows of LEDs is or are supported, as well as a device having improvements in structure and functions as will be seen.

SUMMARY OF THE INVENTION

It is a major object of the invention to provide for improvements in portable illumination devices as referred to. Basically, the device comprises:

a) an elongated portable carrier including a housing and a longitudinal elongated window, b) multiple LEDs carried to emit light toward and through the window, c) and circuitry associated with the housing to supply electrical power to the LEDs, said circuitry incorporating resistor, capacitor and diode elements to reduce AC input voltage to a level for supply to the LEDs.

As will be seen, the LEDs are preferably spaced apart longitudinally to face toward the window, the spacing of successive LEDs in a row being at least 1.75 centimeters, and the illumination window itself being at least about 12 to 15 inches long. Two such rows of LEDs are preferably provided within a generally tubular plastic housing or carrier between 2½ and 4 centimeters in overall diameter or cross section.

Another object is to provide a hand grip sleeve fitting over one end portion of the generally tubular carrier, the voltage reducing circuitry located at least partly within that end portion, whereby a non-bulky, rugged, reliable, lightweight illumination device is achieved. A support hook may be associated with the opposite end portion of the carrier, as on a second sleeve fitting that opposite end portion.

These and other objects and advantages of the invention, as well as the details of an illustrative embodiment, will be more fully understood from the following specification and drawings, in which:

DRAWING DESCRIPTION

DETAILED DESCRIPTION

Figure 1:
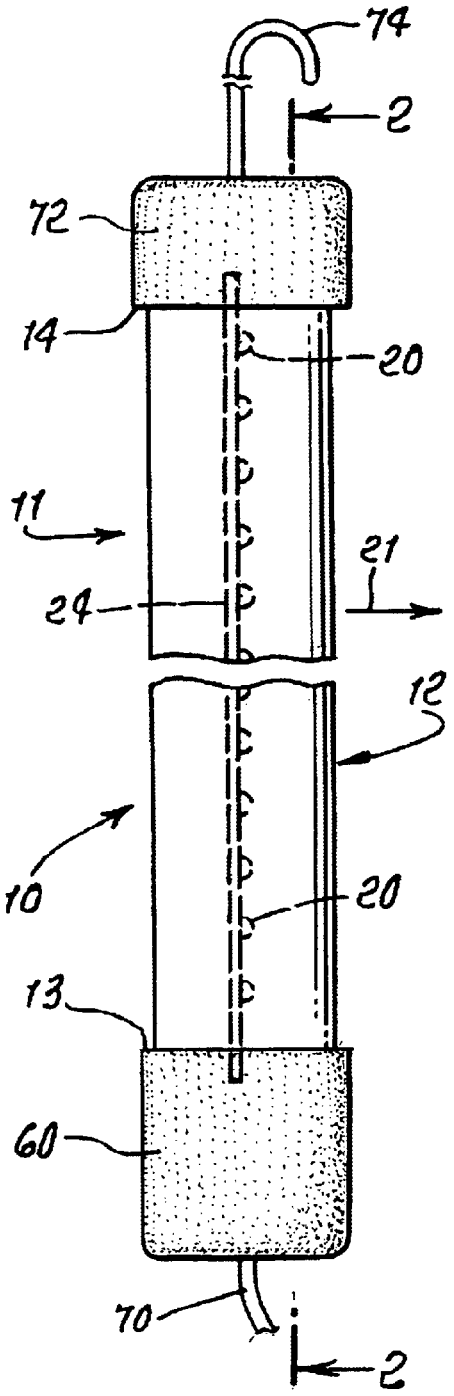
FIG. 1 is a side elevation showing a preferred device incorporating the invention.
Figure 2:
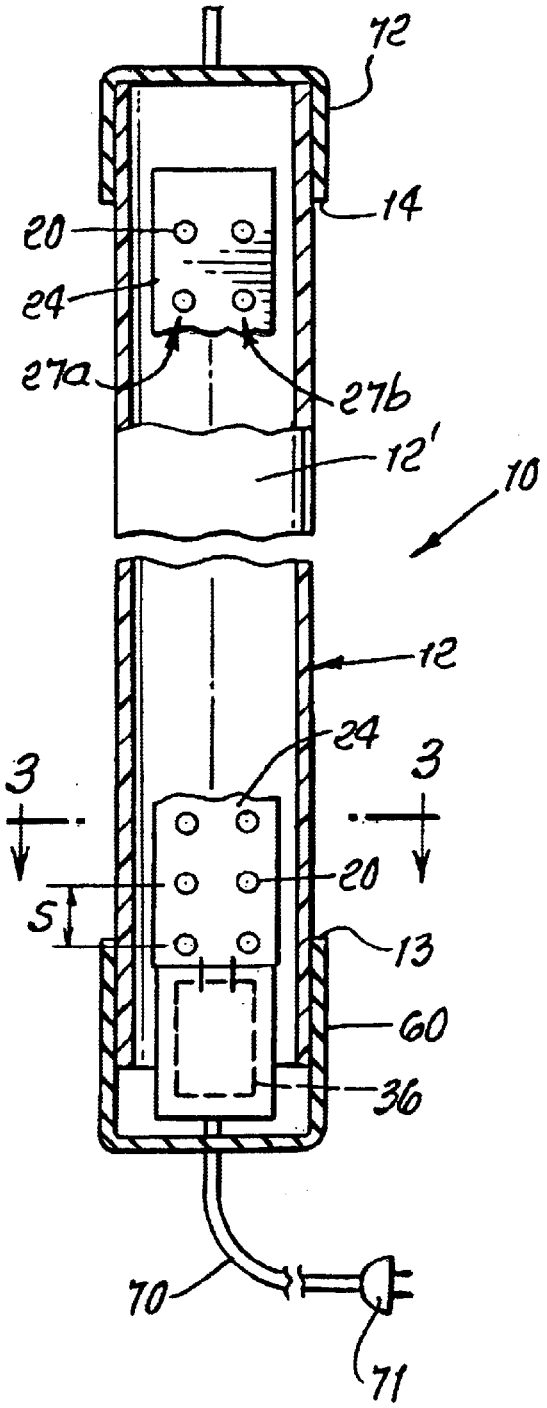
FIG. 2 is a view taken on lines 2—2 of FIG. 1, showing the LEDs.

In FIGS. 1 and 2, the illumination device 10 includes an elongated portable carrier 11, having a housing and a longitudinally elongated window 12'. The housing may be integrated with the window, and may comprise a generally tubular body, or tube 12 which may consist of rigid, transparent, plastic material. The window 12', i.e. exposed section of the tube 12, extends between or is exposed between locations 13 and 14 shown in FIG. 2.

Multiple LEDs 20 are carried to emit light through the window, generally in direction 21, indicated in FIG. 1. The length of the window, for example between 12 and 15 inches, achieves a concentrated light beam of that width indicated at 22 in FIG. 3. The overall diameter of the tube is preferably between 2½ and 4 centimeters.

The LEDs are typically carried by a thin circuit board 24 extending within the tube 12, with board edges 25 engaging the tube bore 26, for stable locations of the board and LEDs. The LEDs 20 are indicated as spaced apart in two rows 27*a* and 27*b* to face the internal side of the window 12'. The LEDs are preferably alike, whereby the beam intensity is approximately the same across width 22 and along the window length. The successive LED spacing "s" in each row is at least about 1.75 centimeters, and preferably about 2.00 centimeters, for optimum illumination.

Figure 3:
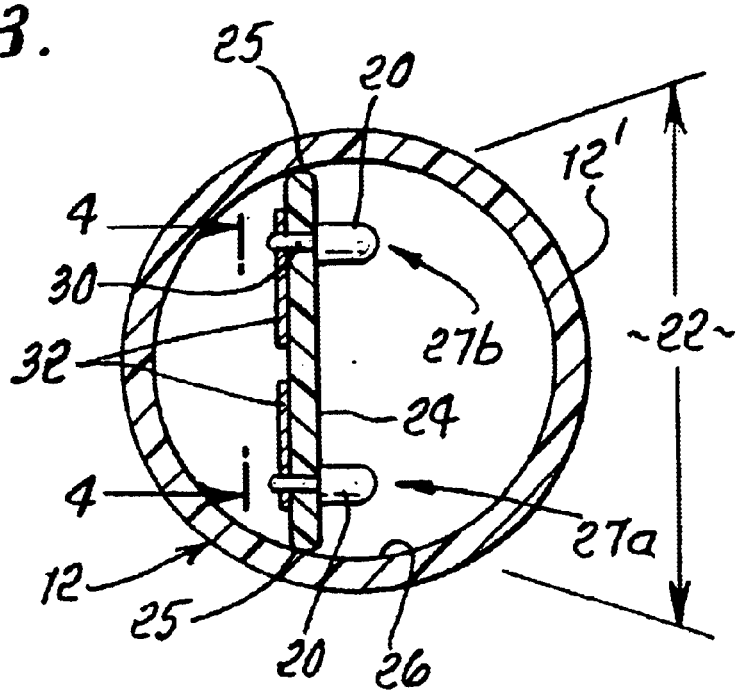
FIG. 3 is an enlarged section taken on lines 3—3 of FIG. 2.
Figure 4:
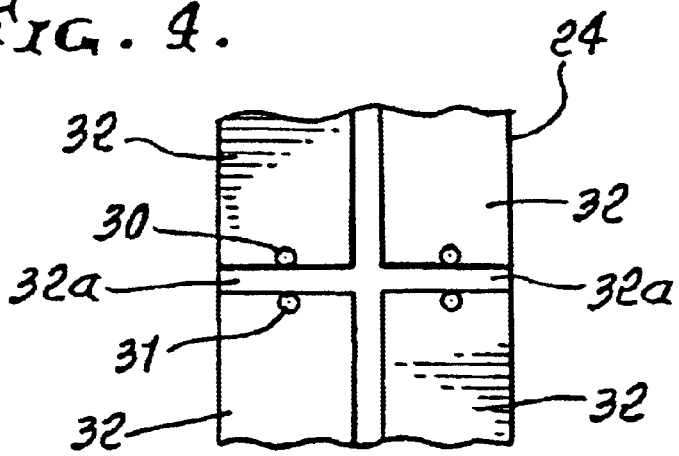
FIG. 4 is a view taken on lines 4—4 of FIG. 3.
Figure 5:
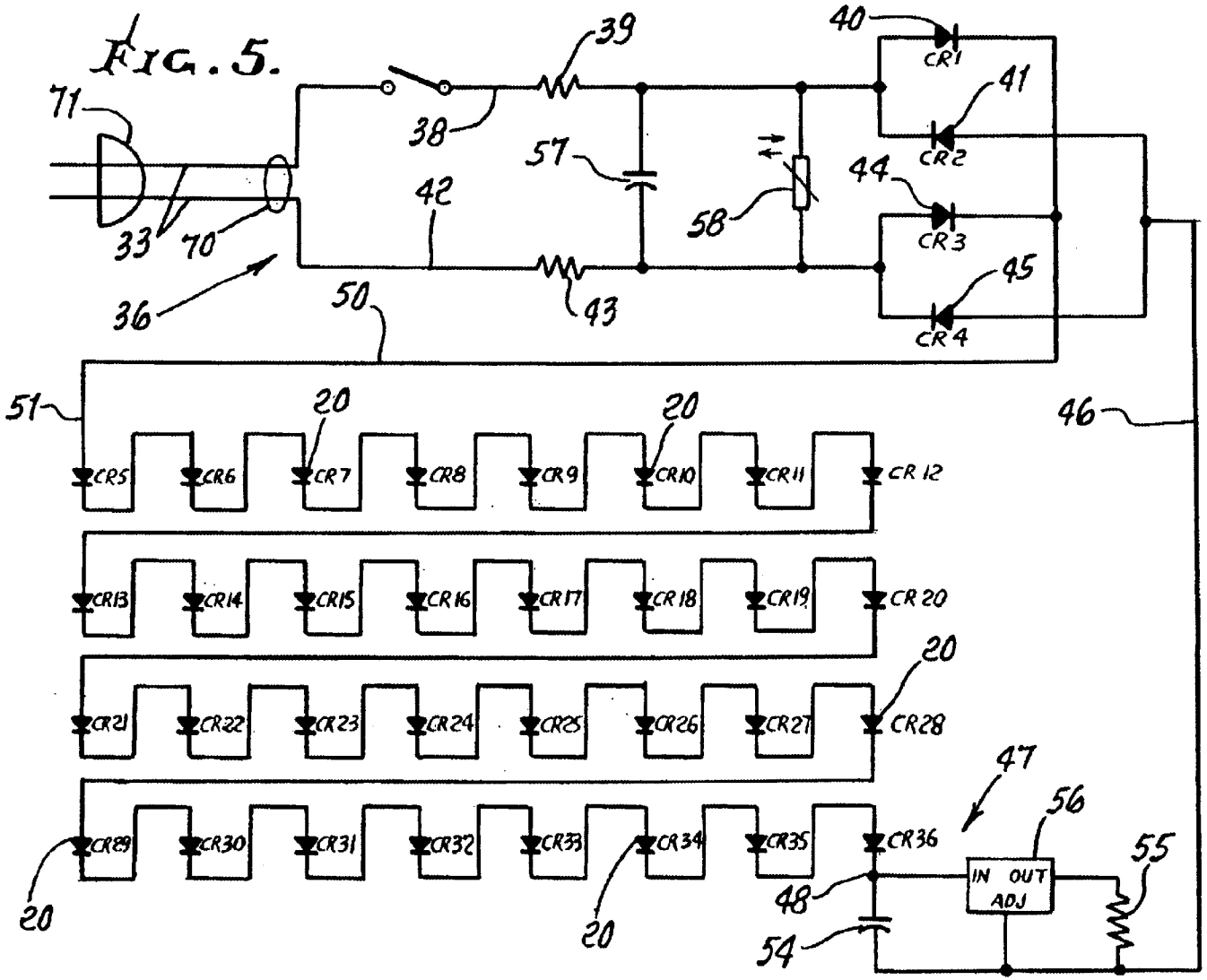
FIG. 5 is an LED circuit diagram.

FIGS. 3 and 4 show LED wires or terminals 30 and 31 projecting through the board, to mount the LEDs, and engaging spaced planar electrical conductor areas 32 on the back side of the board. Note gaps 32*a* between 32. The LEDs are electrically connected in series, as is seen in FIG. 5. That view also shows resistor, capacitor, and diode circuitry at 36 for reducing voltage supplied at 33 from 120 volts to about 12 volts applied to the LEDs.

The circuitry 36 includes branch 38 containing resistor 39 in series with parallel connected diodes 40 and 41, reversely poled, as shown. Branch 42 includes resistor 43 in series with parallel connected diodes 44 and 45, reversely poled as shown. Diodes 41 and 45 are connected via DC carrying line 46 to a circuit 47 at one end 4B of the LED sequence. Diodes 40 and 44 are connected via line 50 to the opposite end 51 of the LED sequence. A capacitor 57 and a transient suppressor 58 are connected across branches 38 and 42; and circuit 47 includes a parallel capacitor 54 and resistor 55, and a voltage regulator 56. All LEDs may be identified as NSPW500B5 components, and are connected in series. Typically, voltage drops from about 107 volts to 30 volts across the LED sequence.

A protective sleeve 60 fits over one end portion of the tube or body 12 as shown in FIGS. 1 and 2. It encloses the circuitry 36 other than the diodes, such circuitry typically mounted on the circuit board, and sleeve 60 may be bonded to the tube. It provides a grip for the user's hand manipulation. Current supply wire 70 extends through the grip, to an electrical plug 71, connectable to 60 cycle, 120 volt AC. A protective sleeve 72 is received on the opposite end portion of tube 12, and may carry a hook 74, to hang the illumination apparatus onto equipment being worked on.

I claim:

1. An illumination device, comprising, in combination:

a) an elongated portable carrier including a housing and a longitudinally elongated window, b) multiple LEDs carried to emit light toward and through the window, c) and circuitry associated with the housing to supply electrical power to the LEDs, said circuitry incorporating resistor, capacitor and diode elements to reduce AC input voltage to a level or levels for supplying voltage to the LEDs, d) said LEDs being located in two substantially parallel rows, the longitudinal spacing between adjacent LEDs in each row being at least about 1.75 centimeters, there being between 13 and 18 LEDs in each row, said LEDs electrically connected in series sequence, e) an elongated substrate supporting the LEDs, the LEDs having terminals engaging edges of spaced planar electrical conductors on the substrate, the carrier being hollow and the substrate and LEDs located within the carrier, the substrate having edge mounting to the carrier, f) and circuitry connected to the LEDs, said circuitry including a first branch having a first resistor connected in series with said diode elements having parallel connected first diodes which are reversely poled, said circuitry including a second branch having a second resistor connected in series with said diode elements having parallel connected second diodes which are reversely poled, the first branch operatively connected with one end of said sequence of LEDs, the second branch operatively connected with the opposite end of said sequence of LEDs via a voltage regulator.

2. The combination of claim 1 wherein the carrier includes an elongated generally tubular body defining said window.

3. The combination of claim 2 wherein said body comprises a transparent plastic tube.

4. The combination of claim 2 including a sleeve fitting over one end portion of the body, said circuitry located in the body inwardly of said sleeve.

5. The combination of claim 4 including a hook associated with the opposite end portion of the body.

6. The combination of claim 2 including said elongated substrate extending within the tubular body, said LEDs facing said window, said body also supporting said circuitry.

7. The combination of claim 1 wherein said carrier is generally tubular, and has an overall diameter of between 2½ and 4 centimeters.

8. The combination of claim 1 wherein said circuitry also includes a capacitor and a transient suppressor both connected across said branches.

9. The combination of claim 8 including said voltage regulator connected between said second branch and said opposite end of the sequence of LEDs, said regulator carried by said substrate, inwardly of a sleeve fitting on an end portion of a tubular body.

10. The combination of claim 1 including the spaced planar electrical conductor areas on the back side of the substrate.

11. An illumination device, comprising, in combination:

a) an elongated portable carrier including a housing and a longitudinally elongated window, b) multiple LEDs carried to emit light toward and through the window, c) and circuitry associated with the housing to supply electrical power to the LEDs, said circuitry incorporating resistor, capacitor and diode elements to reduce AC input voltage to a level or levels for supplying voltage to the LEDs, d) said LEDs being located in two substantially parallel rows, there being between 13 and 18 LEDs in each row, said LEDs electrically connected in series sequence, e) an elongated substrate supporting the LEDs, the LEDs having terminals engaging edges of spaced planar electrical conductors on the substrate, the carrier being hollow and the substrate and LEDs located within the carrier, the substrate having edge mounting to the carrier, f) and circuitry connected to the LEDs, said circuitry including a first branch having a first resistor connected in series with parallel connected first diodes which are reversely poled, said circuitry including a second branch having a second resistor connected in series with said diodes which are reversely poled, the first branch operatively connected with one end of said sequence of LEDs, the second branch operatively connected with the opposite end of said sequence of LEDs via a voltage regulator.

* * * * *